US006076943A

United States Patent [19]

Lassovsky

[11] Patent Number: 6,076,943

[45] **Date of Patent: *Jun. 20, 2000**

[54] LUMINAIRE

[76] Inventor: Leon A. Lassovsky, Castillo de Utera #1, Seville, Spain, 41013

[ * ] Notice: This patent is subject to a terminal disclaimer.

[21] Appl. No.: 09/137,786

[22] Filed: Aug. 21, 1998

Related U.S. Application Data

[63] Continuation-in-part of application No. 08/703,845, Aug. 27, 1996, Pat. No. 5,855,427.

[60] Provisional application No. 60/004,772, Oct. 4, 1995.

[51] Int. Cl.[7] ..... F21V 21/14

[52] U.S. Cl. ..... 362/283; 362/220; 362/284; 362/324

[58] Field of Search ..... 362/217, 220, 362/277, 282, 283, 285, 297, 301, 284, 319, 322, 346, 260

[56] References Cited

U.S. PATENT DOCUMENTS 2,258,354 10/1941 Doane .
2,284,534 5/1942 Orth .
2,330,924 10/1943 Rolph .
2,436,635 2/1948 DeBishop, Jr. .
2,574,031 11/1951 Gretener .
2,619,585 11/1952 Peters .
3,099,403 7/1963 Strawick .
3,166,253 1/1965 Aron .
3,866,036 2/1975 Taltavull .
4,007,365 2/1977 Stempfle et al. .
4,499,529 2/1985 Figueroa .
4,625,267 11/1986 Mikalonis .
4,651,259 3/1987 Wendel .
4,872,098 10/1989 Romano .
5,207,496 5/1993 Stanuch et al. .
5,426,575 6/1995 Richards .
5,564,815 10/1996 Littman et al. .

*Primary Examiner*—Thomas M. Sember
*Attorney, Agent, or Firm*—Gifford, Krass, Groh, Sprinkle, Anderson & Citkowski, P.C.

[57] ABSTRACT

A reflector assembly for reflecting light from a bulb in a luminaire is designed to be mounted within the body of the luminaire between the bulb and the top of the luminaire. The reflector assembly includes a reflector support unit which is configured for mounting within the luminaire body such that it can be adjusted upwardly and downwardly within the luminaire body. The reflector assembly also includes at least one reflector mounted to the support unit. The reflector may be removably and pivotably mounted and may be adjusted to reflect light in a desired manner. The reflector assembly may also include an adjustment mechanism which allows the coordinated adjustment of several reflectors.

24 Claims, 10 Drawing Sheets

LUMINAIRE

CROSS-REFERENCE TO RELATED APPLICATIONS

This is a continuation-in-part of U.S. patent application Ser. No. 08/703,845 filed Aug. 27, 1996, now U.S. Pat. No. 5,855,427 which claims the benefit of U.S. Provisional Application Serial No. 60/004,772 filed Oct. 4, 1995.

I. FIELD OF THE INVENTION

This invention relates to a luminaire, and more particularly, to a luminaire having adjustable reflectors positionable to increase efficiency and energy conservation.

II. BACKGROUND OF THE INVENTION

Luminaires or light fixtures for use with fluorescent bulbs have been in use for many years. Luminaires typically have rectangular box-like bodies which are adapted to be mounted in ceilings. The luminaire is generally provided with some type of reflectors positioned longitudinally behind or alongside of the fluorescent bulb to reflect light outwardly from the luminaire into the area desired to be lit.

Recently, energy conservation and efficiency of luminaires has been improved by the use of reflectors formed of specular material, such as silver or aluminum. These materials reflect light with greater precision than previous materials and permit the lighting engineer to control the manner in which the light is reflected.

State of the art luminaires are currently custom manufactured to meet luminosity criteria desired for the installation site. To ensure the installation of the most suitable lighting fixtures, on-site measurements are taken, appropriate reflector designs are chosen, and the reflector material, usually in the form of sheet metal, is bent or molded into reflectors composed of many precise angles at which the light is to be reflected without causing unsightly overlap with the resultant beams of light. Such a procedure is time consuming and expensive. If the measurements are not carefully taken, it may be necessary to rebuild the luminaire or to make other adjustments which lead to diminution of the efficiency of the energy utilized.

It is also known to provide a luminaire with movable reflectors which may be positioned to change the physical dimensions of the light column produced by the light fixture, such as disclosed in U.S. Pat. No. 3,099,403 to Strawick.

It is also known as disclosed in U.S. Pat. No. 3,166,253 to provide a luminaire having a plurality of movable slats or reflectors positioned outwardly from fluorescent bulbs. The reflectors are movable together like a Venetian blind to simulate natural light coming through a Venetian blind.

However, none of the presently known devices provide the necessary adjustments to increase energy efficiency and energy conservation.

Accordingly, it is desirable to provide a luminaire which has adjustable and interchangeable reflectors which are easily positionable to provide maximum efficiency for a full range of applications or adjusted for a different application.

SUMMARY OF THE INVENTION

Thus disclosed is a novel luminaire having an outer body and a support structure for mounting of both fixed and pivotable reflectors. The support structure is positionable within the body to widen or narrow the width of the beam of light emitted from the luminaire. Additionally, the support structure can be angled within the body to provide an asymmetrical light beam if desired. The movable reflectors are mounted to pivotal mounts connected to positioning rods to provide precise adjustment of the directional light reflectivity. The reflectors are mounted to brackets to permit ready substitution of reflectors having different reflection characteristics. Alteratively, the luminaire can be provided with a two-sided or three-sided reflector. Each of the sides having different reflective characteristics. The reflectors are pivotable so that the side with the desired characteristics can be chosen.

Also disclosed is a novel reflector assembly for reflecting light from a bulb in a luminaire. The luminaire is of the type having an elongated body with a top and a pair of sidewalls defining an opening for permitting a beam of light to be emitted. The luminaire also has first and second ends and supports a bulb in the elongated body between the light emitting opening and the top. The reflector assembly includes a reflector support unit which can be mounted within the body of the luminaire between the opening and the top. The ends of the support unit are configured to interconnect with the ends of the luminaire body and are independently, vertically adjustable in a linear direction so as to adjust the distance between each end of the support unit and the corresponding end of the opening in the luminaire body. The reflector assembly includes one or more reflectors mounted to the support unit that reflect light from the bulb. In some embodiments, a plurality of reflectors is included, each positioned to reflect a portion of the light coming from the luminaire bulb. In some embodiments, the reflectors are pivotally mounted to the support unit so that they can pivot around their longitudinal axis.

A more complete understanding of this invention may be obtained from the following detailed description as well as taken with the accompanying drawings.

DETAILED DESCRIPTION OF THE PREFERRED EMBODIMENTS

Figure 1:
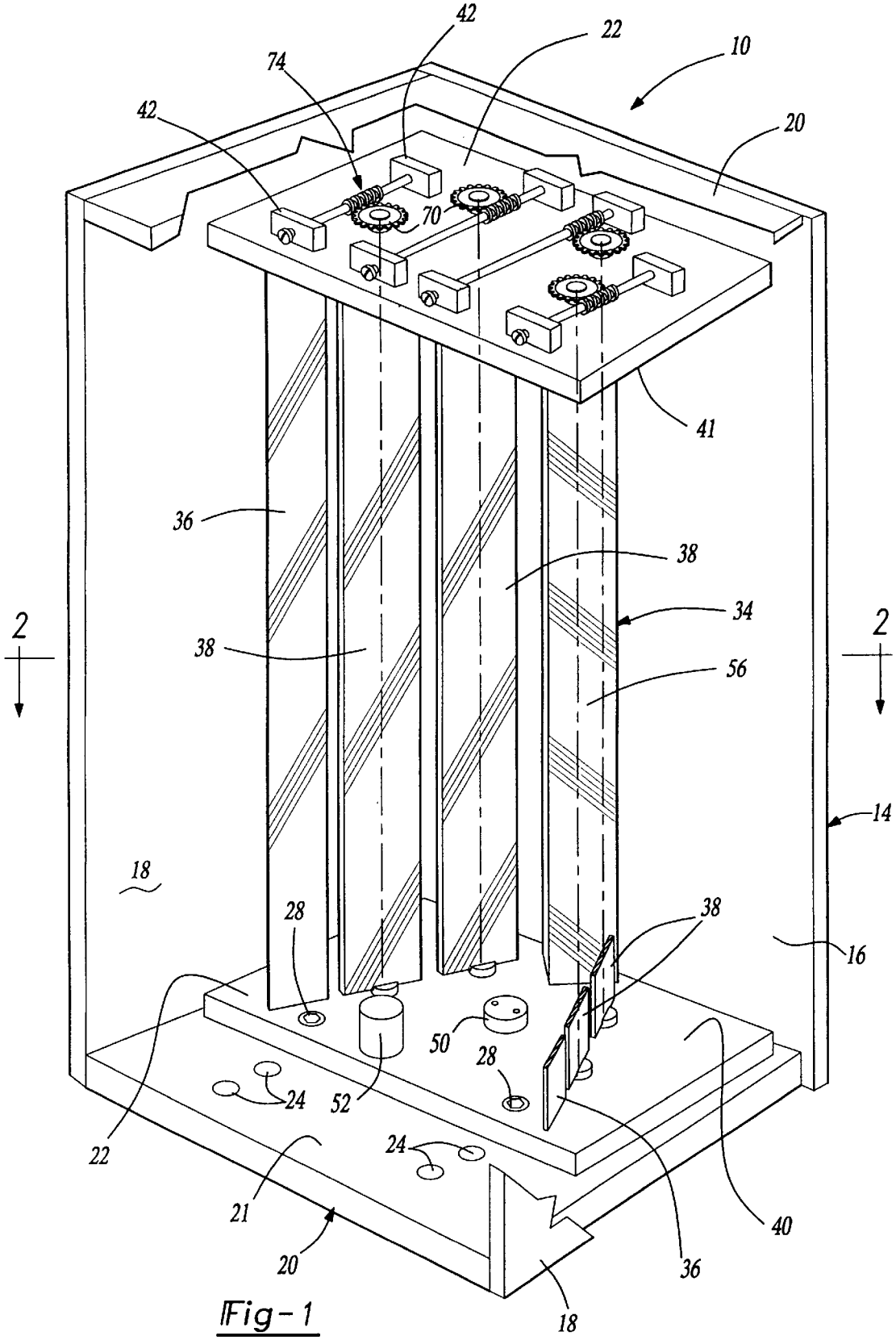
FIG. 1 is a partially exploded perspective view of a luminaire according to the invention.
Figure 2:
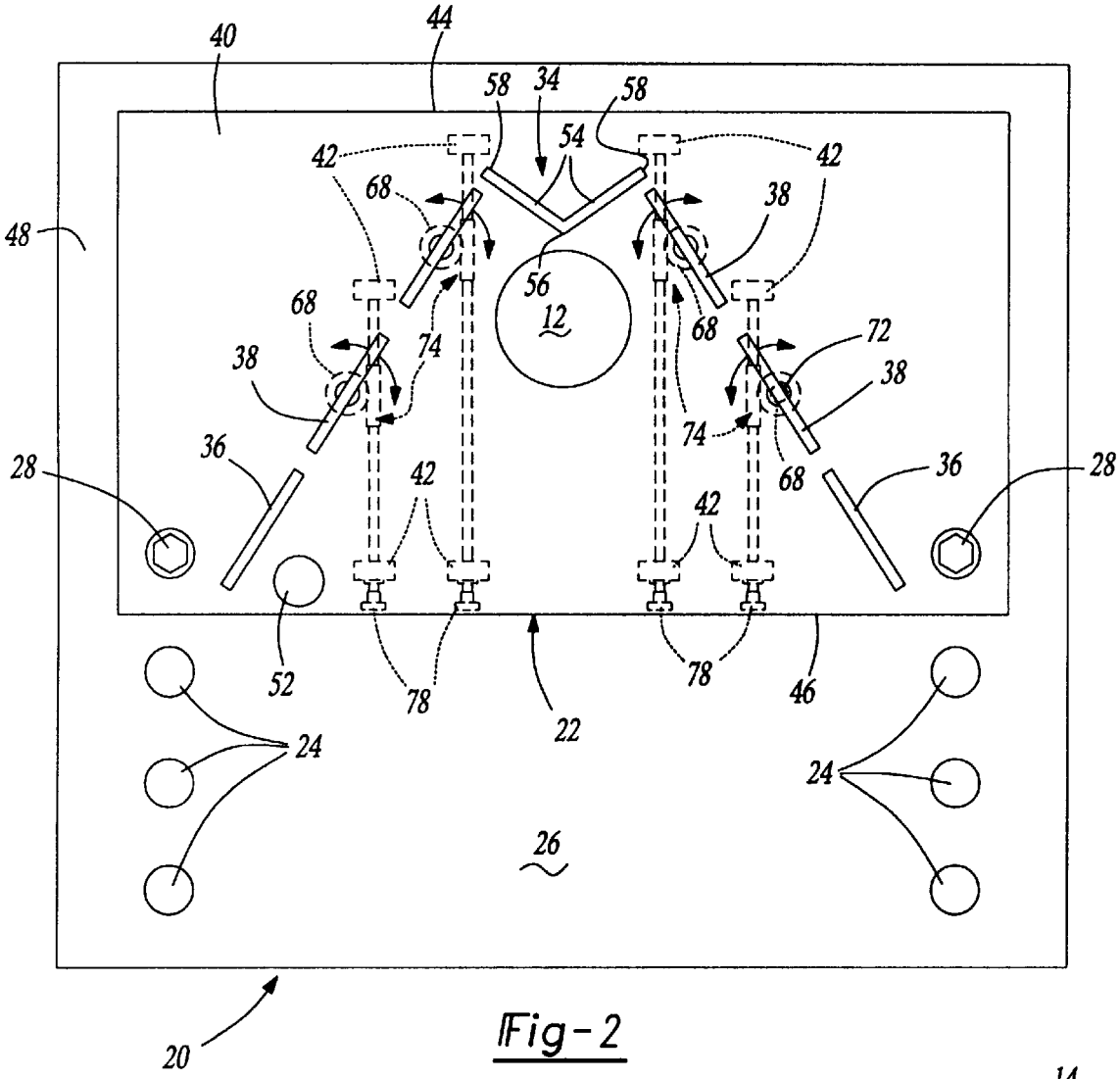
FIG. 2 is a cross-sectional view of the luminaire taken along lines 2—2 of FIG. 1.

A luminaire 10 for a fluorescent light 12 according to the invention is best shown in FIGS. 1 and 2. The luminaire 10 is suitable for mounting in a ceiling suspended or recessed in a ceiling or wall (not shown). The luminaire 10 includes a rectangular box-like body 14 having an opening for accepting a conventional lite (not shown). The body 14 has a top 16 and a pair of sides 18 which extend between a pair of ends 20. The body 14 is formed of a rigid, heat resistant material such as aluminum.

A support unit 22 is adjustably mounted to inner sides 26 of each end 20 of the body 14. Two vertically aligned rows of threaded apertures 24 are formed in the ends 20 for receiving bolts 28 for mounting the support unit 22 to the body 14.

Figure 3A:
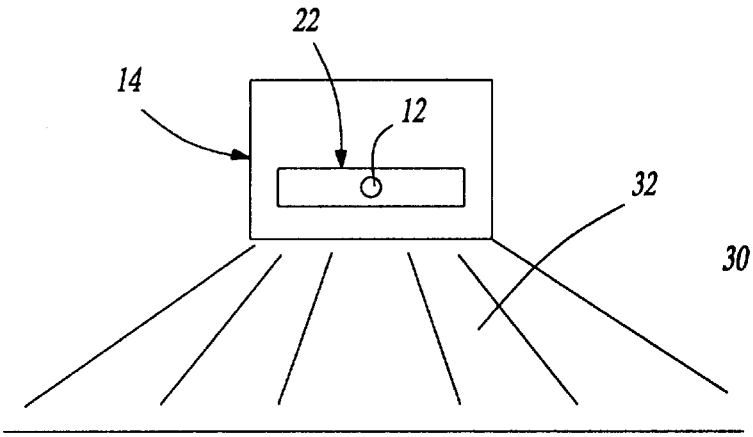
FIG. 3*a* is a schematic end view of the luminaire with the support unit in a lowered position producing a wide distribution beam of light.
Figure 3B:
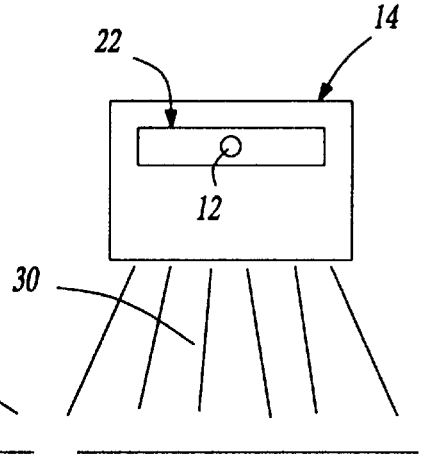
FIG. 3*b* is a schematic view of the luminaire with the support unit in a raised position producing a narrow distribution beam of light.

As discussed more fully below, and shown in FIGS. 3*a* and 3*b*, the rows of apertures 24 permit mounting of the support unit 22 in a range of positions to vary the width of the projected beam of light. In a raised position shown in FIG. 3*b*, the support unit 22 projects a narrow width beam 30 of light. In a lower position, shown in FIG. 3*a*, the support unit 22 projects a wide width beam 32 of light. The support unit 22 may be angled with respect to the opening 21 for producing an asymmetric beam of light.

As shown in FIG. 2, the support unit 22 includes a pair of end pieces 40, 41 supporting the fluorescent bulb 12, a fixed center reflector 34, a pair of fixed side reflectors 36 and two pairs of movable reflectors 38. The end pieces 40, 41 are generally rectangular in shape having an inner edge 44, outer edge 46, and a pair of side edges 48. As discussed more fully below, the end piece 40 is spaced apart from the inner surface 26 of the housing 14 by spacer brackets 42. The ends of the fluorescent bulb 12 are received in sockets 50 mounted on each end piece 40, 41. The bulb 12 thus extends along a longitudinal axis within the body 14 and support member 22. An electronic ballast 52 is also mounted on the end piece 40.

The fixed center reflector 34 is mounted by brackets to each end piece 40, 41. The center reflector 34 has two lateral sides 54 extending in a "V" from a corner 56. The corner 56 of the "V" is mounted between the socket 50 and the inner edge 44 of the end pieces. The sides 54 of the center reflector 34 extend parallel with the longitudinal axis of the fluorescent bulb 12 to reflect light through the opening 21.

Figure 13:
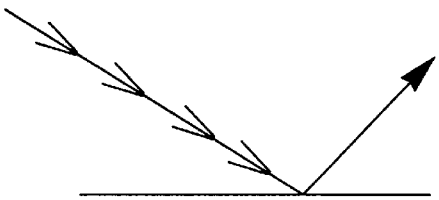
FIG. 13 is a diagram showing a light ray being reflected from a specular surface.
Figure 14:
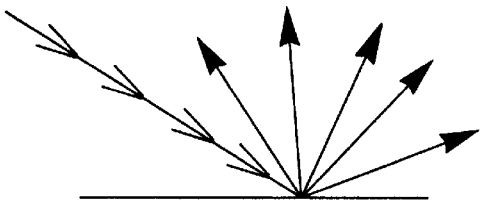
FIG. 14 is a diagram of a light beam being reflected from a diffuse surface.

The fixed side reflectors 36 are mounted on either side of the bulb 12 adjacent the outer edge 48 of the end pieces 40, 41. In the preferred embodiment, the fixed reflectors 36 extend along a plane which extends parallel to the longitudinal axis of the fluorescent bulb 12 and intersects the outer edge 58 of each side 54 of the center reflector. The fixed reflectors 36 are made of suitable rigid material and are coated to reflect light. The reflectors 34, 36 may be provided with any of a variety of coatings or materials to provide either spectral reflection or diffuse reflection. For instance, silver coating will provide a reflection with a minimal diffuse reflection, while a white enamel coating will provide a relatively low spectral reflection with a relatively great diffuse reflection. These types of reflection are illustrated in FIGS. 13 and 14. FIG. 13 shows how light is reflected from a specular surface such as one with a silver coating. FIG. 14 shows how light is reflected from a diffuse surface such as one having a white enamel coating.

As best shown in FIGS. 1, 2, 4 and 4*a*, the movable reflectors 38 are mounted to the end pieces by an adjustment mechanism including mounting brackets 42 and an adjustment rod 74. The mount 62 has a shaft 66 extending from a flange 68 for mounting the movable reflector 38. The shaft 66 is positioned through an aperture 72 in the end piece with the flange 68 extending outwardly from the inner surface of the end piece. A gear wheel 70 is mounted on an opposite end of the rod 74 extending into the space formed by the spacer bracket 42 between the end piece 40 and the body 14.

Figure 4:
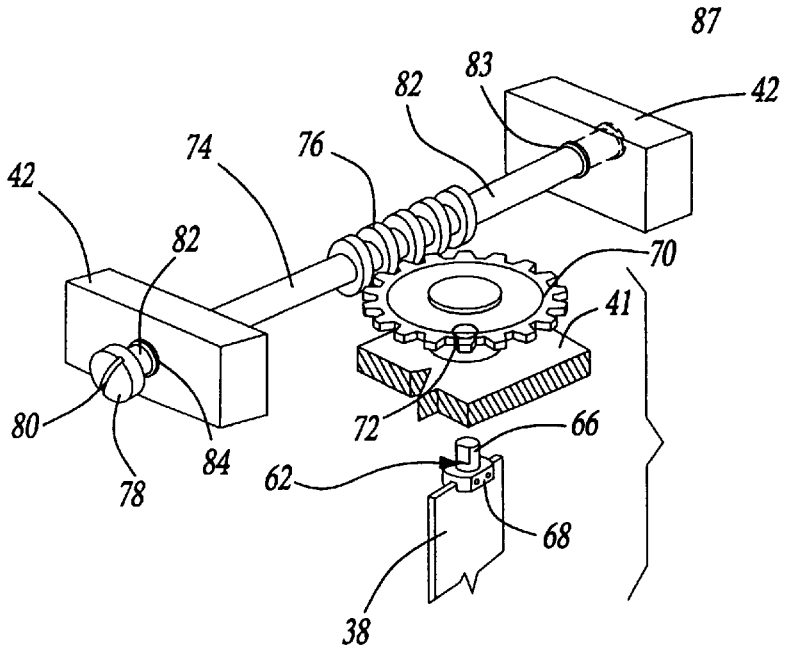
FIG. 4 is a perspective view of an adjustment mechanism for the movable reflectors in accordance with the invention.

As best shown in FIG. 4, an adjustment rod 74 having a worm gear 76 is mounted in meshing engagement with each gear wheel 70 by the pair of spacer brackets 42. Each adjustment rod 74 has an outer end having a head portion 78 having a slot 80 for accepting a blade of a screwdriver for rotating the rod 74. The outer surface may be grooved or knurled to facilitate rotation by hand. The worm gear 76 is positioned between a pair of cylindrical portions 82 which are received in an aperture 83 of each of the respective spacer brackets 42. An annular flange or stop 84 is formed on the rod to abut each bracket 42 to position the head portion 78 of the rod near the outer edge 46 of the end piece and position the worm gear 76 in engagement with the gear 70.

Figure 5:
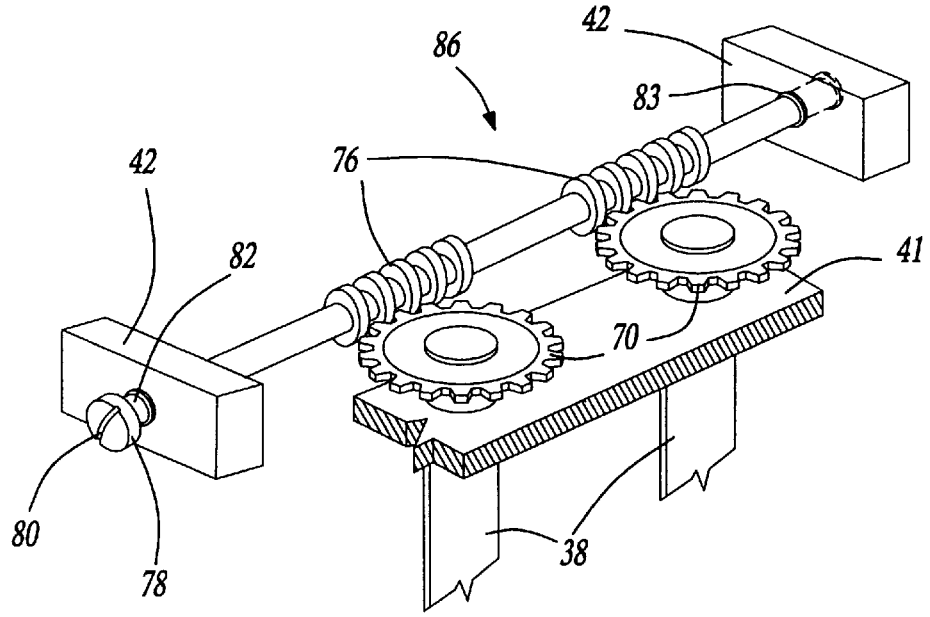
FIG. 5 is a first alternative embodiment of an adjustment mechanism for the movable reflector.

A first alternative embodiment of the adjustment mechanism is shown in FIG. 5. A rod 86 is formed with a pair of worm gears 76 to engage a pair of gear wheels 70 to adjustment of a pair of reflectors simultaneously.

Figure 6:
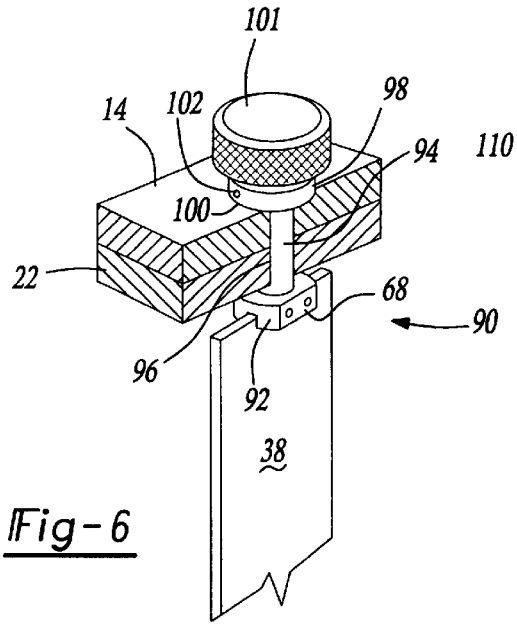
FIG. 6 is a perspective view of a second alternative adjustment assembly for the reflectors.

A second preferred embodiment of the adjustment mechanism is shown in FIG. 6, in which the end pieces of the support unit are mounted directly to the body without brackets 42. The reflectors 38 are pivotally mounted by a mount 90 which has a flange 68 extending from a disk 92 mounted to a shaft 94 which is formed to extend through the bore 96 which is formed through both the support unit 22 and the body 14. The end of the shaft 86 may be provided with a slot 80 as above or knurled to accept a knob 101. A disk 98 having a collar 100 and set screw 102 is mounted to secure the shaft 86 in position in the bore 96.

Figure 4A:
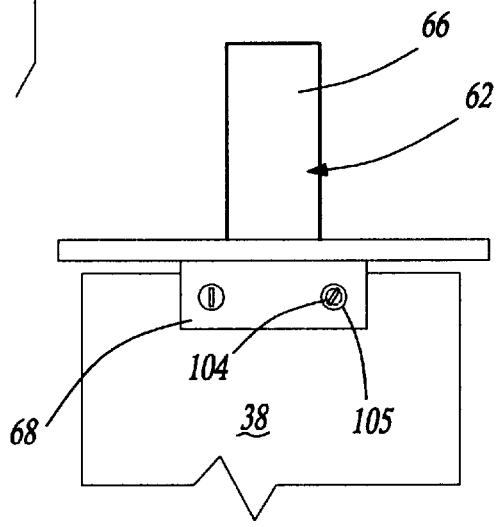
FIG. 4*a* is a partial side view of a mounting mechanism and a reflector.
Figure 7:
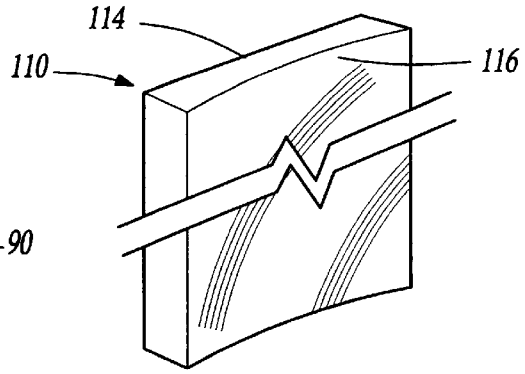
FIG. 7 is a perspective view of a two-sided reflector in accordance with the invention.
Figure 8:
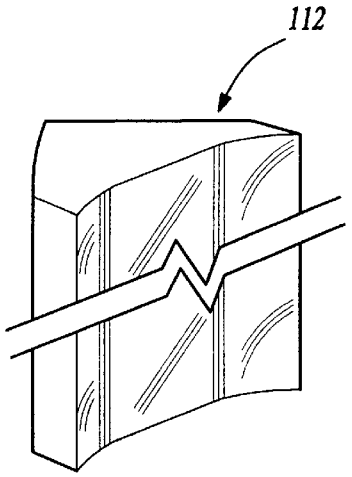
FIG. 8 is a perspective view of a three-sided reflector in accordance with the invention.

As shown in FIG. 4*a*, each rotating reflector 38 is rectangular and formed of a rigid material, such as aluminum or fiberglass. It is advantageous to proportion the width of the reflector to range between the diameter and circumference of the lamp, for instance, between ½" and 4.5". The length of the reflector 38 is approximately equal to the length of the fluorescent bulb 12. This length can exceed 70 inches in length. At least one hole 104 is formed at each end of the reflector 38 for receiving a screw 106 for attachment to the flange 68 of the mount. The reflector is shown in FIG. 4 with a flat surface. However, other surface shapes, such as concave or convex, can be used to provide the desired optics. As shown in FIGS. 7 and 8, a two surface reflector 110 or a three surface reflector 112 may be used. The two surface reflector 110 has a flat surface 114 and a concave surface 116. However, any other shape can be provided. The surfaces may have the same shape with different coatings. The two surface reflector 110 allows the user the option of rotating the reflector 110 from flat surface 114 to a concave surface 116 according to the illumination criteria used.

Figure 9A:
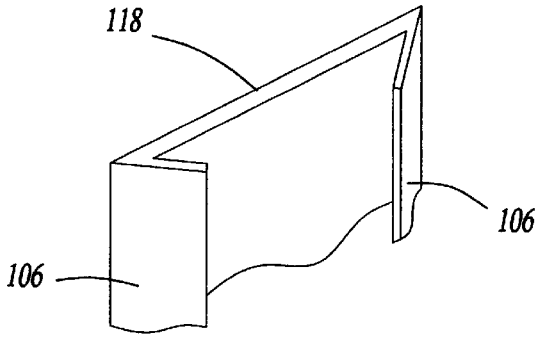
FIG. 9*a* is a perspective view of a reflector having a flat reflective surface.
Figure 9B:
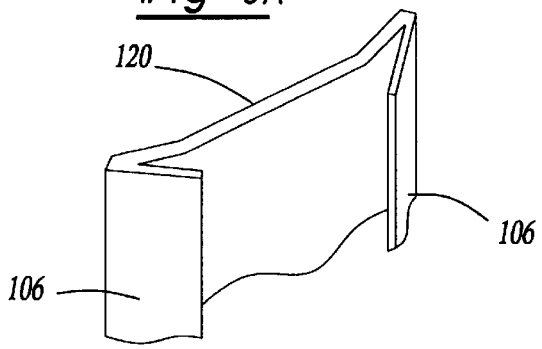
FIG. 9*b* is a perspective view of a reflector having a concave reflective surface.
Figure 9C:
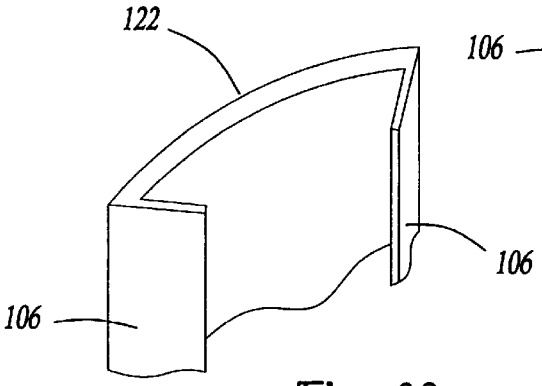
FIG. 9*c* is a perspective view of a reflector having a convex reflective surface.

As shown in FIGS. 8, 9*a*, 9*b*, and 9*c*, the three surface reflector 112 can be produced by combining a flat surface reflector 118 as shown in FIG. 9*a*, a concave surface reflector 120 as shown in FIG. 9*b*, together with a convex surface reflector 122 as shown in FIG. 9*c*. The reflectors are joined by fastening angled flanges 106 together.

Although shown with two pairs of reflectors 38, three pairs or more may be provided. The spacing between the reflectors 38 permits an effective flow of cooling air to flow through the luminaire to cool the fixture.

Figure 10:
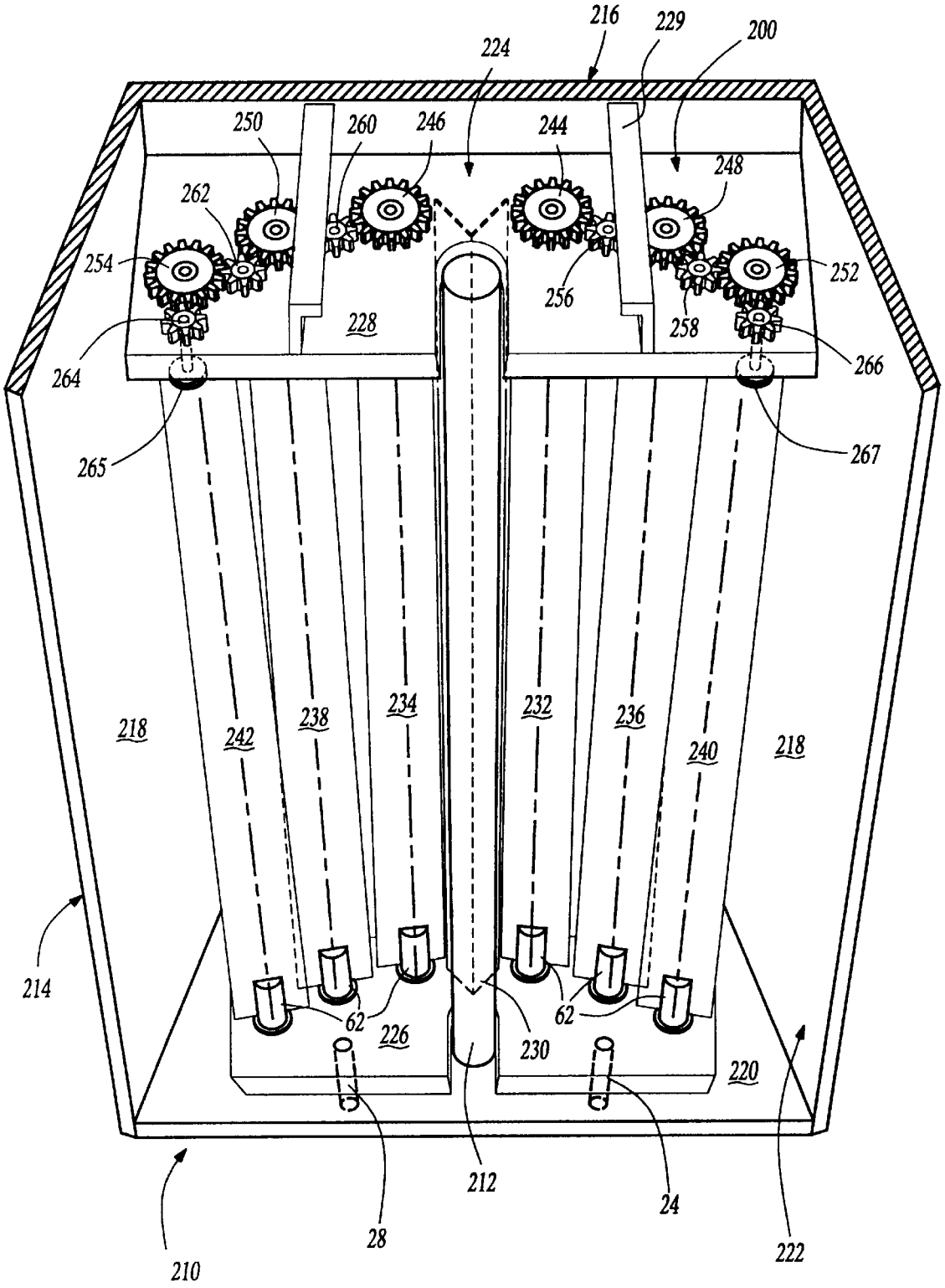
FIG. 10 is a perspective view of a reflector assembly according to the present invention mounted in a luminaire body with a portion of the luminaire body cut away to show the adjustment mechanism.

Referring now to FIG. 10, a second preferred embodiment of the present invention is shown. In this embodiment, the invention comprises a reflector assembly 200 which is designed to reflect light from a bulb 212 in a luminaire 210. This embodiment differs from the earlier embodiment in that the bulb 212 is directly supported by the luminaire 210 rather than by the reflector assembly 200. The reflector assembly 200 of this embodiment can therefore be retrofit to an existing luminaire without modifying the bulb mounting wiring and position. Alternatively, the reflector assembly 200 can be used as part of a new luminaire.

The luminaire 210 has a body 214 made up of a top 216 and a pair of sides 218 which extend between a first end 220 and a second end 221 of the luminaire 210. The sides 218 define an opening 222 for permitting a beam of light to be emitted. The light emitted from the luminaire is made up of two parts, a direct light beam and a reflected light beam. The direct light beam is formed by the light which radiates directly from the bulb 212 out through the opening 222. The bulb 212 radiates in other directions as well and it is the function of the reflector assembly 200 to reflect this light back through the opening 222 as a reflected light beam. The luminaire 210 supports the bulb 212 in the body 214 between the opening 222 and the top 216. The second end 221 of the luminaire 210 has been removed in FIG. 10 to more clearly illustrate the invention.

The reflector assembly 200 includes a reflector support unit 224 which includes a first end 226 and a second end 228. The reflector support unit 224 is configured to be mounted within the body 214 of the luminaire 210 between the opening 222 and the top 216. When installed in the luminaire body 214, the first end 226 of the reflector support unit 224 is adjacent the first end 220 of the luminaire body 214 and the second end 228 of the reflector support unit 224 is adjacent the second end 221 of the luminaire body 214. The ends 226 and 228 of the support unit 224 are designed to be interconnected with the adjacent ends 220 and 221 of the luminaire body 214 so that each end 226 and 228 of the reflector support unit 224 is independently, vertically adjustable in a linear direction so as to adjust the distance between each end, 226 and 228, of the support unit 224 and the opening 222 of the luminaire body 214. By adjusting the distance between the reflector support unit 224 and the opening 222 of the luminaire body 214, the shape of the reflected light beam emitted from the luminaire 210 can be adjusted as was shown in FIGS. 3*a* and 3*b*. In this embodiment, the direct light beam projecting downward from the bulb 212 will not be affected by repositioning the reflector support unit 224. However, the reflected light beam from the reflector assembly 200 will be affected by repositioning the support unit 224. It is also possible to mount the reflector assembly 200 within the luminaire body 214 at an angle relative to the opening 222. This may be desirable where the application requires a non-symmetrical reflected beam of light.

The reflector assembly 200 can be mounted within the luminaire body 214 in any of a number of ways as will be clear to one of skill in the art. As was discussed earlier and illustrated in FIG. 1, bolts 28 which engage threaded apertures 24 may be used. This approach is also illustrated in FIG. 10 which shows the first end 226 of the support unit 224 being interconnected with the first end 220 of the luminaire body 214 using bolts 28 which engage threaded apertures 24. A plurality of threaded apertures 24 may be provided in the ends 220 and 221 of the luminaire body 214 to allow for adjustment in the position of the reflector assembly 200.

An alternative approach is shown with the second end 228 of the support end 224. On this end, support brackets 229 are shown attached to the second end 228 of the support unit 224. The support brackets 229 can serve a variety of functions. First, the support brackets 229 support the second end 228 in an offset position from the second end 221 of the luminaire body 214 so as to provide clearance for an adjustment mechanism, such as the one discussed below. Secondly, the support brackets 229 provide a means to interconnect the end 221 of the luminaire body 214 with the end 228 of the support unit 224. Depending on the application, especially where a retrofit is contemplated, it may be necessary to adapt the luminaire body 214 so that the reflector assembly 200 can be supported therein. Support brackets 229 of various sizes and shapes can be used to adapt the luminaire body 214. The support brackets 229 would first be mounted to the inside of the end 221 of the luminaire body 214 using screws or bolts or other connection means. The brackets 229 would then provide a variety of attachment points for interconnection with the end 228 of the support unit 224 thereby allowing adjustment in the position of the connector assembly 200.

Other interconnection means are also possible. For example, rivets may be used to interconnect the ends 226 or 228 of the support unit 224 with the ends 220 or 221 of the luminaire body where easy adjustment of the position of the reflector assembly 200 is not required. This would simply require drilling a hole through the end 226 or 228 of the support unit 224 and through the end 220 or 221 of the luminaire body 214 and using a rivet to interconnect the two holes. Rivets could also be used to connect a bracket 229 to either the luminaire body 214 or the support unit 224. Alternatively, support unit 224 may include tabs which extend outwardly from the ends 226 and 228. The luminaire body 214 may include holes, or holes may be added, so that the tabs on the support unit 224 may engage the holes in the body 214 of the luminaire 210. Yet other interconnection means are also possible as will be clear to one of skill in the art. This includes gluing or welding the support unit 224 to the body 214 or ultrasonically welding the two together if they are plastic.

The reflector assembly 200 also includes one or more reflectors. In the illustrated embodiment, the reflector assembly 200 includes a fixed center reflector 230 positioned directly above the bulb 212. For purposes of description, a central plane is defined as longitudinally bisecting the support unit 224 such that it passes through the opening 222 of the luminaire body 214 when the support unit 224 is mounted within the luminaire body 214. The central plane longitudinally bisects the reflector support unit 224 such that the longitudinal axis of the bulb 212 and the longitudinal axis of the fixed center reflector 230 are contained within the central plane. Using the central plane as a reference, three reflectors are positioned on each side of the central plane. On one side of the central plane is a first reflector 232, a third reflector 236 and a fifth reflector 240. On the other side of the central plane, and symmetrical with the other three reflectors, 232, 236, and 240, are a second reflector 234, a fourth reflector 238, and a sixth reflector 242. Alternatively, the reflector assembly 200 may include fewer or a greater number of reflectors. Also, the reflectors may have two or more sides as shown in FIGS. 7 and 8. The reflectors may have either a specular or diffuse surface and may be flat, concave, or convex depending on the application.

Like in the earlier described embodiments, the reflectors 232–242 are pivotally mounted to the support unit 224 such that each reflector can pivot with respect to the support unit about its own longitudinal axis. Further, the reflectors 232–242 are preferably detachably mounted to the reflector support unit. A preferred approach for interconnecting reflectors and the reflector support assembly 224 was discussed earlier and shown in FIG. 4*a*.

Referring back to FIGS. 4*a* and 6, details of one preferred approach to supporting the reflectors 232–242 is illustrated. Each end of the reflectors are mounted to a mount 62. The mount 62 includes a flange 68 for mounting an end of a reflector. The reflectors have holes 104 which align with holes in the flange 68 and accept screws 106 for holding the reflectors to the mount 62. The mount 62 also includes a shaft 66 extending from the flange 68. Referring also to FIG. 10, the shafts 66 of the mounts 62 pass through holes in the ends 226 and 228 of the reflector support unit 224. In this way, the reflectors 232–242 are supported for pivotal movement. Adjustment gear wheels are mounted to the mount 62 at the end of the shafts 66 opposite the flanges 68 at one end of the reflectors 232–242. In this way, the position of each adjustment gear wheel determines the pivotal position of each reflector.

Figure 11:
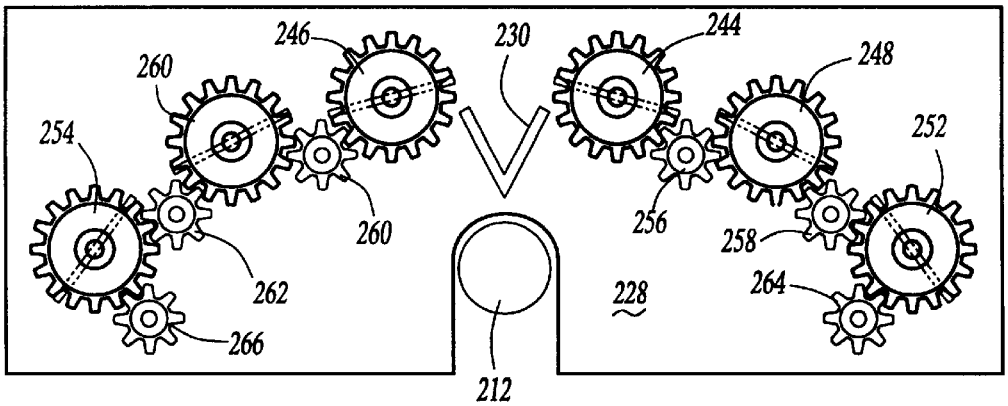
FIG. 11 is an end view of a reflector assembly according to the present invention showing one embodiment of an adjustment mechanism for the pivotally mounted reflectors.
Figure 12:
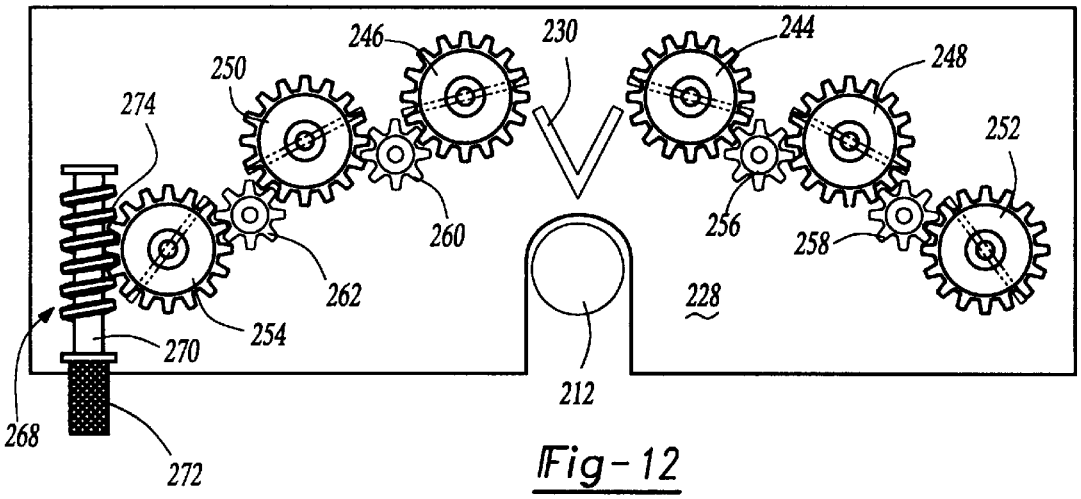
FIG. 12 is an end view of a reflector assembly according to the present invention having a different adjustment mechanism.

Several different adjustment mechanisms are envisioned with the ones illustrated in FIGS. 10, 11, and 12 being preferred. As discussed above, adjustment gear wheels are interconnected with the reflectors 232–242 by the mounts 62. A first adjustment gear wheel 244 controls the first reflector 232, a second adjustment gear wheel 246 controls the second reflector 234, a third adjustment gear wheel 248 controls the third reflector 236, a fourth adjustment gear wheel 250 controls a fourth reflector 238, a fifth adjustment gear wheel 252 controls the fifth reflector 240, and a sixth adjustment gear wheel 254 controls the sixth reflector 242. The adjustment mechanism also includes coordinating gears which mesh with and interconnect the adjustment gear wheels so that the adjustment gear wheels, and the reflectors, move in a coordinated manner. A first coordinating gear 256 is positioned adjacent and engages both the first and the third adjustment gear wheels 244 and 248 so that the first coordinating gear 256 and the first and third adjustment gear wheels, 244 and 248, rotate together. Likewise, a second coordinating gear 258 is positioned adjacent and engages both the third adjustment gear wheel 248 and the fifth adjustment gear wheel 252. A third coordinating gear wheel 260 and a fourth coordinating gear wheel 262 likewise engage the adjustment gear wheels 246, 250, 254 on the other side of the luminaire thereby coordinating their movement.

Figure 21:
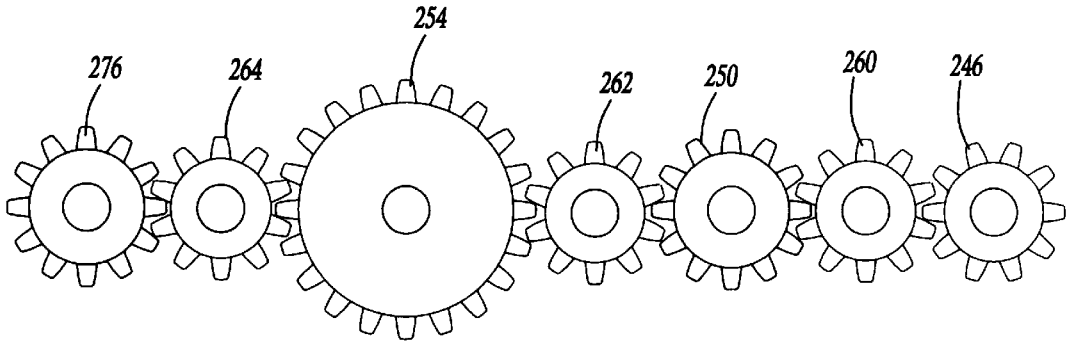
FIG. 21 is a view of adjustment and coordinating gears showing the variation in diameter.
Figure 22:
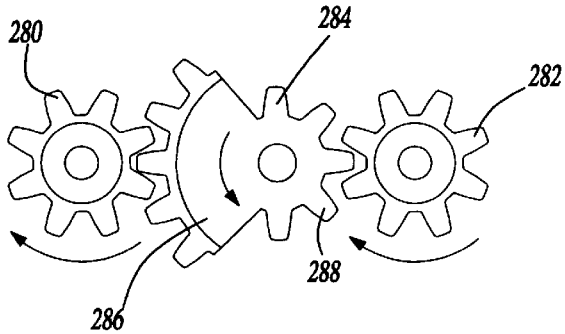
FIG. 22 is a view of two adjustment gears and an alternative coordinating gear.

As shown, the adjustment gear wheels 244–254 are each identical in size to each other. The coordinating gears 256–262 are also identical in size to each other but are smaller in size than the adjustment gear wheels 244–254. With this configuration, the first, third, and fifth, 232, 236, 240, reflectors all rotate an identical amount when any one of them is turned. Alternatively, the sizes of the adjustment gear wheels 244–254 and the coordinating gears 256–262 may be adjusted so that various reflectors turn by different amount. It is desired that the gear sizes be chosen such that the reflectors nearest the bulb rotate less than the reflectors further from the bulb. In one preferred arrangement, for a given amount of adjustment, the reflector nearest the bulb rotates half the amount of the reflector second from the bulb which in turn rotates half as much as the reflector furtherest from the bulb. For example, for a given adjustment of drive gear 266, reflector 232 will rotate 5 degrees, reflector 236 will rotate 10 degrees, and reflector 240 will rotate 20 degrees. The actual ratios of the gear sizes will depend upon the desired reflection pattern and the application of the luminaire. The variation in rotation ratios for a given adjustment can be achieved in several ways as will be clear to one of skill in the art. For example, the adjustment gear wheels 244–254 may be of different diameters so as to achieve different amounts of rotation for the various reflectors. One particularly preferred embodiment of this approach is illustrated in FIG. 21. This figure adopts the numbering as used on the coordinating gears and adjustment gears on the left half of the luminaire 210 in FIG. 10. However, for ease of illustration, the gears are arranged in a straight line. Depending on packaging constraints, the gears may be moved out of the straight line configuration. In FIG. 21, a knob gear 276 is connected to an adjustment knob (not shown) and has twelve teeth. Knob gear 276 drives the drive gear 264 which has ten teeth. It in turn drives the sixth adjustment gear wheel 254 having twenty teeth which in turn drives the fourth coordinating gear 262 having ten teeth, which drives the fourth adjustment gear wheel 250 having twelve teeth, which in turn drives the third coordinating gear 260 having ten teeth, which in turn drives the second adjustment gear wheel 246 having ten teeth. Obviously, reflectors attached to the adjustment gear wheels 254, 250, 246 rotate by differing amounts when the knob gear 276 is rotated. By varying the diameter and number of teeth on the adjustment gear wheels 254, 250, 246, the rotation ratios may be selected. Alternatively, the coordinating gears may have different gear ratios on each of their sides so that the adjustment gear wheels which mesh with the coordinating gear turn by different amounts depending on which side of the coordinating gear engages them. This may be achieved by forming the coordinating gear as two half-gears of different diameters as shown in FIG. 22. In FIG. 22, a left adjustment gear wheel 280 and a right adjustment gear wheel 282 both mesh with an intermediate coordinating gear 284 positioned therebetween. As shown, the intermediate coordinating gear 284 has a large diameter portion 286 and a small diameter portion 288 as if the intermediate coordinating gear 284 is formed with pieces of a large diameter gear and a small diameter gear. The intermediate coordinating gear 284 is arranged such that the large diameter portion 286 meshes with the left adjustment gear wheel 280 while the small diameter portion 288 meshes with the right adjustment gear wheel 282. Therefore, for a given rotation of the left adjustment gear wheel 280, the right adjustment gear wheel 282 rotates by a lesser amount but in the same direction as the left adjustment gear wheel 280. Alternatively, the coordinating gears may be made up of a pair of stacked gears with one of the stacked gears engaging one adjustment gear wheel and the other stacked gear engaging the other adjustment gear wheel. Obviously, these various approaches to varying the rotation ratios may also be combined to provide further flexibility.

Also shown in FIGS. 10 and 11, are drive gears 264 and 266 which engage the outermost adjustment gear wheels 252 and 254 respectively. These drive gears are used to adjust the entire adjustment mechanism. For example, the drive gears 264 and 266 may be accessed from below the luminaire 210 and rotated thereby adjusting the position of the reflectors 232–242. The drive gears 264 and 266 are each connected to a knob 265, 267 similar to the one shown in FIG. 6 at 101. A shaft extends from each of the drive gears 264, 266 through the end 228 of the support unit 224 and each has the knob 265, 267 mounted on the inside of the second end 228 of the support unit 224. This allows adjustment of the position of the reflectors 232–242 from inside the luminaire opening 222. A spring may be positioned under the knob to lock the mechanism to avoid movement. Other locking means may also be used.

Referring now to FIG. 12, the worm drive adjuster 268 is substituted for the drive gears 264 and 266. The worm drive adjuster comprises a vertical shaft 270 with a knob 272 on one end and a worm drive gear 274 on its other end. The worm drive gear 274 engages adjustment gear wheel 254 so that the position of the reflectors may be adjusted by rotating knob 272. A second worm drive adjuster may be included on the other side of the reflector support unit to adjust the reflectors on the other side or additional gears may be added so as to interconnect the adjustment gear wheels on each side of the reflector support unit. Alternatively, a longer shaft with several worm drive gears may be used to engage several adjustment gear wheels similar to the approach shown in FIG. 5. As will be clear to one of skill in the art, many other variations on the adjustment mechanism are possible. For example, the adjustment gear wheels may include stops which prevent their rotation beyond a certain position so that the end user of the reflector assembly 200 cannot adjust the reflectors beyond their operating range.

Figure 15:
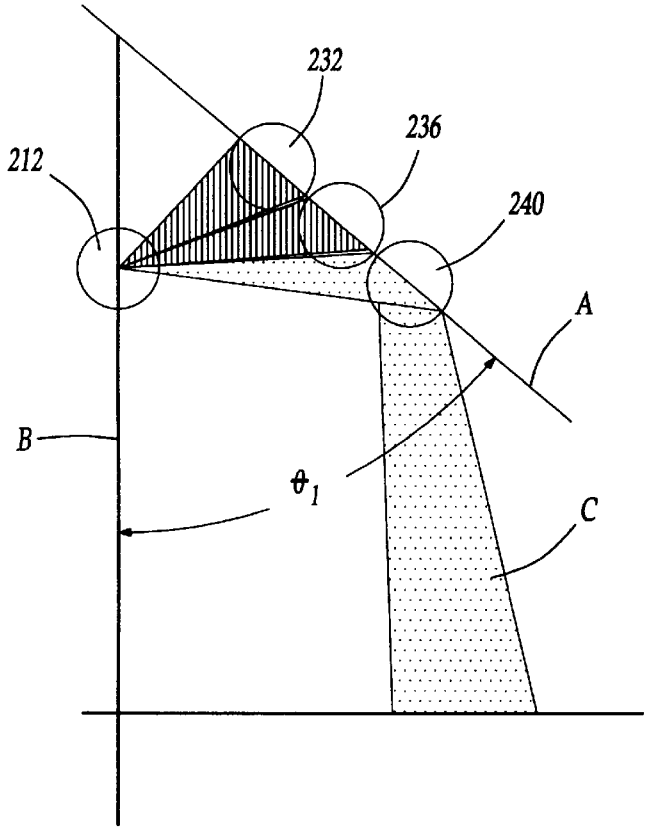
FIG. 15 is a diagram showing light being reflected from reflectors located in a plane positioned such that the reflector assembly creates a narrow reflected light beam.
Figure 16:
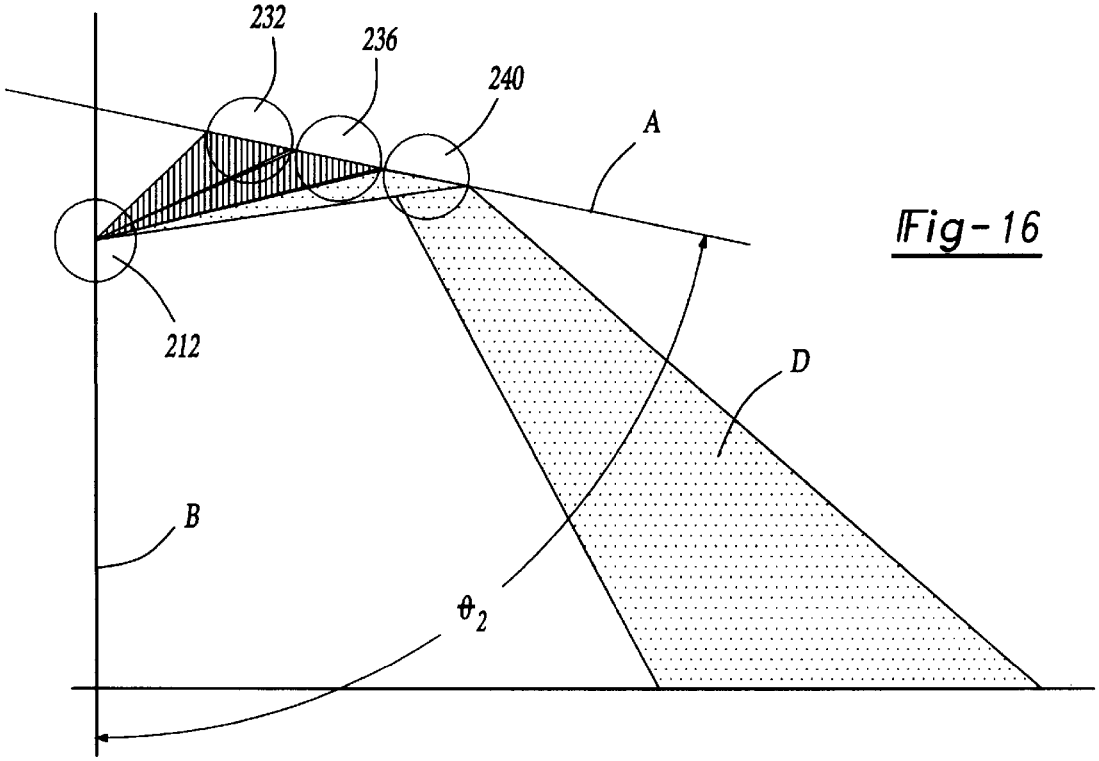
FIG. 16 is a diagram showing reflectors located in a plane positioned such that the reflector assembly creates a wide reflected beam.

Referring now to FIGS. 15 and 16, the effect of reflector positioning is illustrated. In FIG. 15, light is shown radiating from a fluorescent bulb 212 and being reflected from the first, third, and fifth reflectors, 232, 236, 240. The reflectors each have their longitudinal axis located in a plane A which is defined as a first reflector plane. The central plane, discussed earlier, is shown as a vertical line containing the longitudinal axis of the fluorescent bulb 212 and is marked as B. The first reflector plane and the central plane B intersect to define a line which is parallel to the longitudinal axes of the reflectors 232, 236 and 240. The angle formed between the central plane B and the first reflector plane A is defined as a first mounting angle and is illustrated in FIG. 15 as $\theta_1$. Referring now to FIG. 16, the reflectors 232, 236 and 240 are once again shown reflecting light emanating from the fluorescent bulb 212. However, in this case, the first reflector plane A is repositioned so that first mounting angle $\theta_2$ is much larger than first mounting angle $\theta_1$ in FIG. 15. As shown in the figures, the direction and the width of reflected beams are changed. Beam C in FIG. 15 and beam D in FIG. 16 illustrate only that portion of the reflected light beam which is reflected from the fifth reflector 240. In FIG. 15, with a narrow first mounting angle $\theta_1$, the reflected beam C is narrow and reflected almost vertically so that it will illuminate an area near to the central plane B. In FIG. 16, the light beam D reflected from the reflector 240 positioned at a wide first mounting angle $\theta_2$ is wider than the beam C and is directed outwardly away from the central plane B. By changing the mounting angle of the reflector assembly of the present invention, the total width of the reflected beams from the reflector assembly can be limited or expanded.

It should be noted that reflector 240 is positioned such that the reflective surface lies in the first reflector plane A and it is assumed that a flat reflective surface is used. If the reflector 240 were rotated counterclockwise, it would no longer intercept as much light from the bulb with some light passing behind the reflector and not being reflected through the opening. Therefore, the position shown for reflector 240 is the furthest counterclockwise position for efficient reflection of light. Also, the distance of beam C from the central plane B is the furthest from the central plane B that light can be reflected using a flat reflective surface lying in the reflector plane A.

As can be seen, the first mounting angle $\theta_1$ or $\theta_2$ controls how wide a beam of light can be reflected from the reflector located on the first reflector plane. Therefore, a reflector assembly with a narrow mounting angle such as $\theta_1$ in FIG. 15 would be limited in how wide of a reflected beam C it can create. A reflector assembly with a wide mounting angle such as $\theta_2$ in FIG. 16 will be able to reflect light in a much wider beam and much further from the central plane B. Depending on the application, different mounting angles are desirable as will be clear to one of skill in the art. Generally, the mounting angle should not be less than 20 degrees or greater than 90 degrees. Also, the reflectors 234, 238, and 242 on the other side of the central plane B are preferably positioned in a second reflector plane which intersects the central plane at a second mounting angle. This second mounting angle may be the same as the first mounting angle or a different angle depending on the application.

Figure 17:
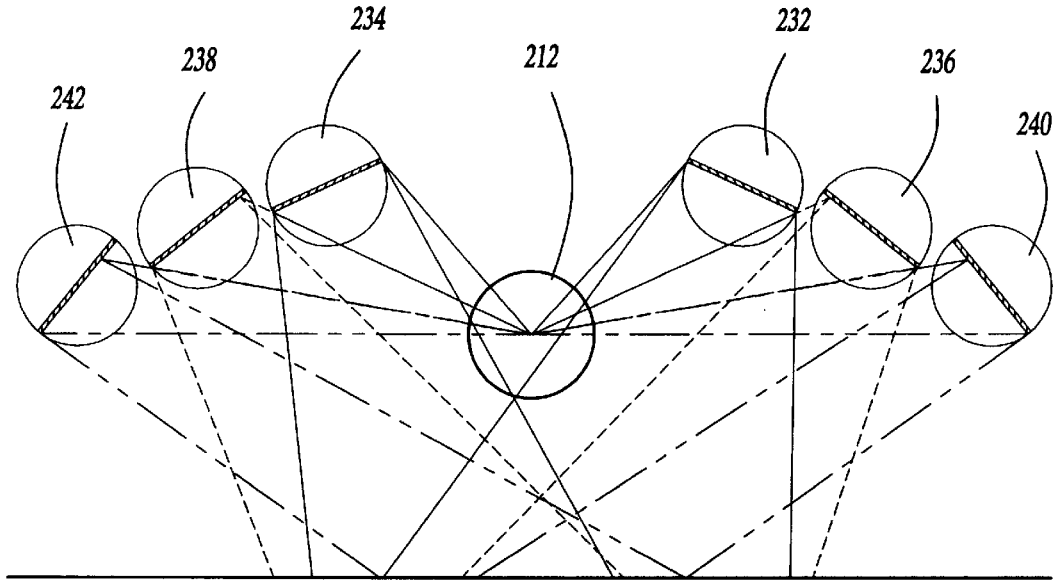
FIG. 17 is a diagram showing light being reflected from a group of reflectors adjusted so as to create a center weighted, focused distribution of light.

Referring now to FIGS. 17–20, a variety of light reflection patterns are shown indicating a variety of patterns which can be created by repositioning the six reflectors 232–242 in the reflector assembly. In FIG. 17, the reflectors 232–242 are positioned such that the reflected beam created by each of the six reflectors is focused on the area directly below the bulb 212. The light reflected from each of the six reflectors also overlaps. This greatly increases the amount of light available in the area directly below the bulb 212. Depending on the configuration, the illumination reflected from each of the reflectors 232–242 is approximately equal to the illumination created by the light radiating directly from the bulb 212. Therefore, by focusing beams created by each of the reflectors 232–242 on the area below the bulb 212, the illumination available directly below the bulb 212 is substantially increased. The pattern created by the reflectors shown in FIG. 17 is called a center weighted, focused distribution of light and is particularly useful where a great deal of illumination is needed in a small area.

Figure 18:
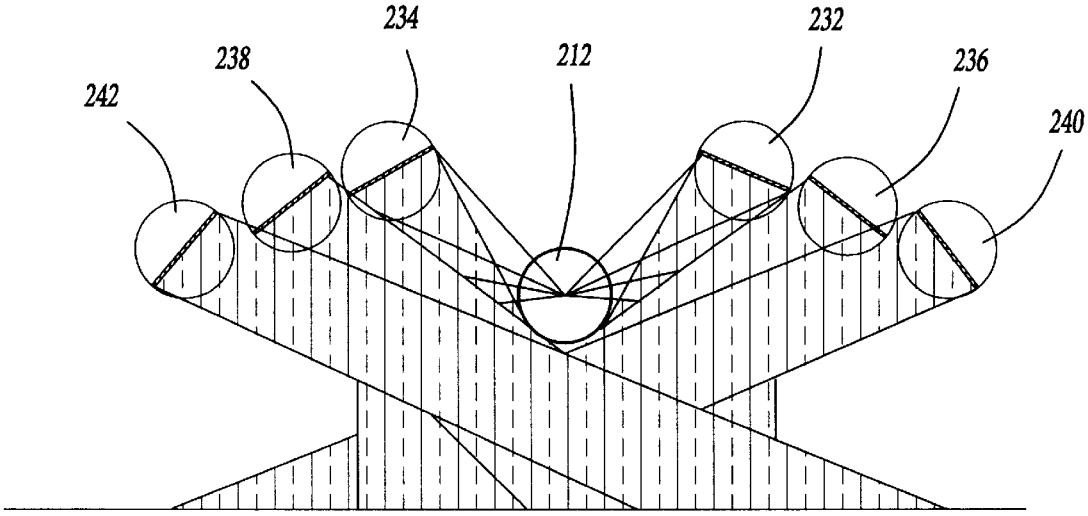
FIG. 18 is a diagram showing light being reflected from a group of reflectors adjusted so as to form a laterally centered distribution of light.

In FIG. 18, the reflectors 232–242 are shown positioned such that the reflected beams of light are more spread out than they were for the position shown in FIG. 17. Once again, the reflected light beams overlap. In this case they are more spread out to form a wider area of increased illumination. This pattern is called a laterally centered distribution of light and is particularly useful where increased illumination is needed in a somewhat larger area than is required for the pattern shown in FIG. 17.

Figure 19:
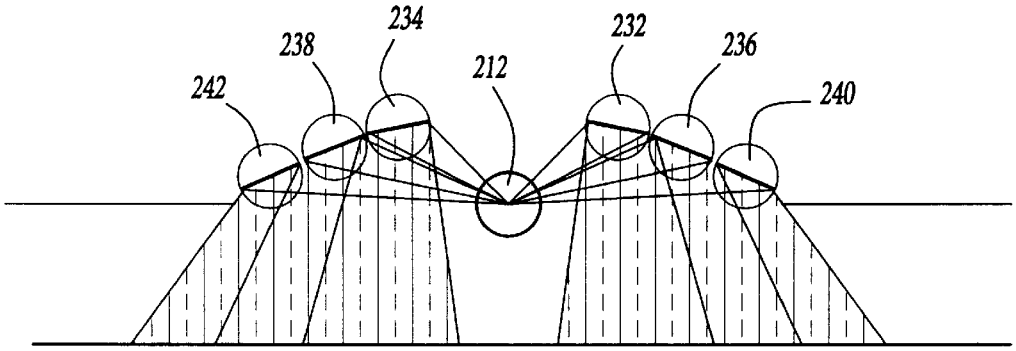
FIG. 19 is a diagram showing light being reflected from a group of reflectors adjusted so as to form a fanned distribution of light.

FIG. 19 shows the reflectors 232–242 positioned such that reflected beams of light are spread out much wider than previously illustrated and the reflected light beams do not significantly overlap. This is a pattern that would be created with the reflective surfaces of the reflectors 232–242 on each side of the bulb 212 positioned in planes much as was shown in FIGS. 15 and 16. As can be seen, the reflected beams do not illuminate the area directly below the bulb 212. This pattern is called a fanned distribution of light and may be useful where a very wide distribution of light is desired or where the area directly below the bulb 212 does not require additional illumination.

Figure 20:
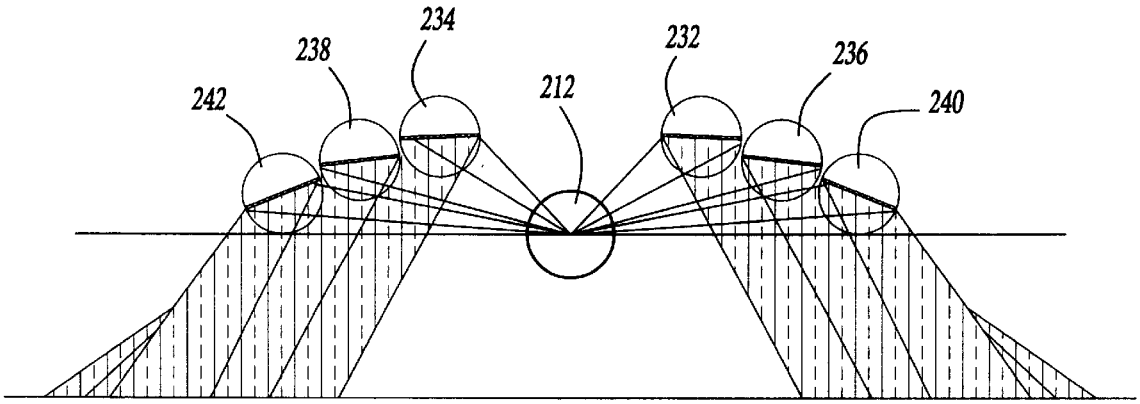
FIG. 20 is a diagram showing light being reflected from a group of reflectors adjusted so as to form a laterally fanned distribution of light.

FIG. 20 shows reflectors 232–242 positioned such that the reflected beams of light are spread even more widely than the pattern shown in FIG. 19. As explained earlier, this positioning allows some light to escape interception by the reflectors and pass behind them. However, this pattern allows for a very wide distribution of light. Depending on the positioning of the individual reflectors, the reflected light beams may overlap so as to create areas of more intense illumination. This pattern is called a laterally fanned distribution of light and is particularly useful where the area below the bulb 212 does not require additional illumination such as if a luminaire is positioned directly above a partition wall.

As will be clear to one of skill in the art, other light patterns may be created by repositioning the reflectors. Also, the above discussed patterns may be combined such that reflectors on one side of the bulb 212 focus light beneath the bulb while the reflectors on the other side of the bulb reflect light away from the location beneath the bulb 212. This may be desirable where the illumination needs are not symmetrical with respect to a luminaire. It should also be noted that the patterns shown in FIGS. 17–20 do not illustrate the light beam directly emitted from the bulb, earlier defined as a direct light beam. The illustrated reflected light beams serve to reinforce the illumination provided by the direct light beam. Therefore, while the direct light beam will tend to provide a uniform level of illumination, the reflected light beams can be used to provide areas of increased illumination where needed.

While there have been described what are present to be the preferred embodiments of the invention, it will be understood that various modifications may be made therein and the invention is intended to cover in the independent claims all such modifications as fall within the true spirit and scope of the invention.

I claim:

1. A reflector assembly for reflecting light from a bulb in a luminaire, the luminaire of the type having an elongated body with a top and a pair of side walls defining an opening for permitting a beam of light to be emitted, the luminaire further having a first end and a second end, the luminaire supporting the bulb in the elongated body between the opening and the top, said reflector assembly comprising:

a reflector support unit having a first end and a second end, said reflector support unit configured for mounting within the body of the luminaire between the opening and the top such that said first end of said reflector support unit is adjacent the first end of the body and the second end of said reflector support unit is adjacent the second end of the body, means for independently, vertically positioning each of said ends of said support unit within the body so as to adjust a distance between said end of said support unit and the opening, said means interconnecting each of said ends of said support unit with the adjacent end of said body;

a reflector mounted to said support unit for reflecting light from the bulb so as to form a reflected beam.

2. The reflector assembly of claim 1, wherein said reflector is pivotally mounted to said support unit to pivot with respect to said support unit about a longitudinal axis of said reflector.

3. The reflector assembly of claim 2, further comprising means for pivotally adjusting said reflector.

4. The reflector assembly of claim 2, further comprising means for detachably mounting said reflector to said support unit.

5. The reflector assembly of claim 2, wherein said reflector further comprises a pair of opposed longitudinal reflective surfaces.

6. The reflector assembly of claim 1, wherein said means for positioning said ends of said support unit includes means for pivotally adjusting said support unit within said body about a longitudinal axis of said support unit.

7. The reflector assembly of claim 1, wherein said positioning means includes an attachment member for interconnecting said support unit and said body.

8. The reflector assembly of claim 7, wherein said attachment member is a threaded member.

9. The reflector assembly of claim 7, wherein said attachment member is a rivet.

10. The reflector assembly of claim 7, wherein said attachment member is a tab extending from said support unit for engaging a hole in the body of the luminaire.

11. The reflector assembly of claim 7, wherein said attachment member is a bracket configured for attachment to the body of the luminaire and said support unit is configured for attachment to said bracket.

12. The reflector assembly of claim 1, further comprising another reflector mounted to said support unit for reflecting light from the bulb, said reflectors cooperating to form a reflected beam.

13. The reflector assembly of claim 1, wherein said support unit comprises a first section including said first end and a second section including said second end; and said reflector extends between said sections.

14. A reflector assembly for reflecting light from a bulb in a luminaire, the luminaire of the type having an elongated body with a top and a pair of side walls defining an opening for permitting a beam of light to be emitted, the luminaire further having a first end and a second end, the luminaire supporting the bulb in the elongated body between the opening and the top, said reflector assembly comprising:

a reflector support unit having a first end and a second end, said reflector support unit configured for mounting within the body of the luminaire between the opening and the top such that said first end of said reflector support unit is adjacent the first end of the body and the second end of said reflector support unit is adjacent the second end of the body, means for independently, vertically positioning each of said ends of said support unit within the body so as to adjust a distance between said end of said support unit and the opening, said means interconnecting each of said ends of said support unit with the adjacent end of said body; and a first and a second reflector mounted to said support unit and disposed on opposite sides of a central plane which longitudinally bisects the support unit, said central plane passing through the opening of the luminaire body when said support unit is mounted within the body of the luminaire.

15. The reflector assembly of claim 14, wherein said first reflector is pivotally mounted to said support unit to pivot with respect to said support unit about a longitudinal axis of said first reflector, and said second reflector is pivotally mounted to said support unit to pivot with respect to said support unit about a longitudinal axis of said second reflector.

16. The reflector assembly of claim 15, wherein said longitudinal axis of said first reflector is disposed in a first reflector plane which intersects the central plane at a first mounting angle, the intersection of the central plane and the reflector plane defining a line which is parallel to the longitudinal axis of the first reflector; and said longitudinal axis of said second reflector is disposed in a second reflector plane which intersects the central plane at a second mounting angle, the intersection of the central plane and the second reflector plane defining a line which is parallel to the longitudinal axis of the second reflector.

17. The reflector assembly of claim 16, wherein said first and second mounting angles are in the range of 20 to 90 degrees.

18. The reflector assembly of claim 16, further comprising a third and a fourth reflector pivotally mounted to said support unit to pivot with respect to said support unit about a longitudinal axis of each said reflector, said longitudinal axis of said third reflector disposed in said first reflector plane, said longitudinal axis of said fourth reflector disposed in said second reflector plane.

19. The reflector assembly of claim 18, further comprising a fifth and a sixth reflector pivotally mounted to said support unit to pivot with respect to said support unit about a longitudinal axis of each said reflector, said longitudinal axis of said fifth reflector disposed in said first reflector plane, said longitudinal axis of said sixth reflector disposed in said second reflector plane.

20. A reflector assembly for reflecting light from a bulb in a luminaire, the luminaire of the type having an elongated body with a top and a pair of side walls defining an opening for permitting a beam of light to be emitted, the luminaire further having a first end and a second end, the luminaire supporting the bulb in the elongated body between the opening and the top, said reflector assembly comprising:

a reflector support unit having a first end and a second end, said reflector support unit configured for mounting within the body of the luminaire between the opening and the top such that said first end of said reflector support unit is adjacent the first end of the body and the second end of said reflector support unit is adjacent the second end of the body, means for independently, vertically positioning each of said ends of said support unit within the body so as to adjust a distance between said end of said support unit and the opening, said means interconnecting each of said ends of said support unit with the adjacent end of said body; and a first and a second reflector pivotally mounted to said support unit to pivot with respect to said support unit about a longitudinal axis of said reflector, said reflectors disposed on opposite sides of a central plane which longitudinally bisects the support unit, said central plane passing through the opening of the luminaire body when said support unit is mounted within the body of the luminaire;

a third and a fourth reflector each pivotally mounted to said support unit to pivot with respect to said support unit about a longitudinal axis of each said reflector, said third and fourth reflectors disposed on opposite sides of the central plane, said third reflector mounted adjacent said first reflector and said fourth reflector mounted adjacent said second reflector;

means for pivotally adjusting said reflectors.

21. The reflector assembly of claim 20, further comprising a first adjustment gear wheel mounted to said first reflector, a second adjustment gear wheel mounted to said second reflector, a third adjustment gear wheel mounted to said third reflector, and a fourth adjustment gear wheel mounted to said fourth reflector.

22. The reflector assembly of claim 21, further comprising coordinating means for coordinating the pivotal adjustment of said reflectors so that light is efficiently reflected from said reflectors.

23. The reflector assembly of claim 22, wherein said coordinating means comprises a first coordinating gear engaging said first and said third adjustment gear wheel so that said first coordinating gear and said first and third adjustment gears wheels rotate together.

24. The reflector assembly of claim 22, wherein said coordinating means comprises a first coordinating shaft having a first and a second worm gear disposed thereon, said first worm gear engaging said first adjustment gear wheel and said second worm gear engaging said third adjustment gear wheel so that said first shaft and said first and third gear wheels rotate together.

* * * * *